US011480192B2

(12) United States Patent
Ray et al.

(10) Patent No.: US 11,480,192 B2
(45) Date of Patent: Oct. 25, 2022

(54) CUTOFF FOR A BLOWER HOUSING

(71) Applicant: Johnson Controls Technology Company, Auburn Hills, MI (US)

(72) Inventors: Elton D. Ray, Wichita, KS (US); Paul J. Lucas, Wichita, KS (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 80 days.

(21) Appl. No.: 16/261,351

(22) Filed: Jan. 29, 2019

(65) Prior Publication Data

US 2020/0217328 A1 Jul. 9, 2020

Related U.S. Application Data

(60) Provisional application No. 62/788,631, filed on Jan. 4, 2019.

(51) Int. Cl.

| | |
|---|---|
| ***F04D 29/40*** | (2006.01) |
| ***F24F 7/06*** | (2006.01) |
| ***F04D 17/16*** | (2006.01) |

(52) U.S. Cl.

CPC ..... *F04D 29/403* (2013.01); *F04D 17/16* (2013.01); *F24F 7/065* (2013.01)

(58) Field of Classification Search

CPC .... F04D 29/403; F04D 17/16; F04D 29/4226; F04D 29/424; F04D 29/428; F24F 7/065; F05D 2250/52

See application file for complete search history.

(56) References Cited

U.S. PATENT DOCUMENTS

| | | | | | |
|---|---|---|---|---|---|
| 1,875,881 | A * | 9/1932 | Morse | F04D 29/424 | 415/206 |
| 2,015,210 | A * | 9/1935 | Witzel | F04D 29/422 | 415/98 |
| 2,776,088 | A * | 1/1957 | Wentling | F04D 25/0613 | 417/354 |
| 2,841,326 | A * | 7/1958 | Davis | F04D 29/422 | 415/97 |
| 3,221,983 | A * | 12/1965 | Trickler | F04D 29/422 | 415/204 |
| 3,619,080 | A * | 11/1971 | Bullock | F04D 29/424 | 415/206 |
| 4,576,549 | A * | 3/1986 | Lanier | F04D 29/4213 | 415/206 |
| 4,735,551 | A | 4/1988 | Schilling | | |

(Continued)

*Primary Examiner* — Jenna M Hopkins

(74) *Attorney, Agent, or Firm* — Fletcher Yoder, P.C.

(57) ABSTRACT

A centrifugal blower includes a centrifugal fan having a fan wheel, the fan wheel has a rotational axis and blades extending radially outwardly from the fan wheel, a blower housing including a first panel and a second panel disposed on opposite sides of the centrifugal fan and extending transverse to the rotational axis of the fan wheel, and further including a wall extending about the rotational axis and between the first panel and the second panel, where the wall includes a flange having a cross-sectional camber geometry, an intake passage extending through the first panel and facilitating fluid flow into the fan wheel, and an outlet of the housing facilitating fluid flow out of the housing, the outlet formed by the first panel, the second panel, and the wall, where the flange extends outwardly from the outlet.

24 Claims, 9 Drawing Sheets

(56) References Cited

U.S. PATENT DOCUMENTS 5,772,399 A * 6/1998 Mehta ..... F04D 27/00 415/148
6,273,679 B1 8/2001 Na
6,439,839 B1 * 8/2002 Song ..... F04D 29/4226 415/119
6,767,184 B2 * 7/2004 Kim ..... F04D 29/422 415/119
6,886,630 B2 * 5/2005 Onda ..... B60H 1/00028 165/202
7,014,422 B2 3/2006 Hancock
7,144,219 B2 * 12/2006 Hancock ..... F04D 29/422 415/212.1
7,163,456 B2 * 1/2007 Miyata ..... B60H 1/00828 165/41
7,334,986 B2 2/2008 Sohn et al.
7,549,842 B2 6/2009 Hanson et al.
8,075,262 B2 12/2011 Watanabe et al.
8,105,026 B2 * 1/2012 Eguchi ..... F04D 29/4226 415/204
8,550,066 B2 10/2013 Post
8,939,826 B2 * 1/2015 Zorzit ..... F24F 1/0035 454/239
9,017,011 B2 * 4/2015 Gatley, Jr. ..... F04D 25/0653 415/98
9,039,363 B2 * 5/2015 Hancock ..... F04D 29/424 415/206
9,261,108 B2 * 2/2016 Van Deventer ..... F04D 29/282
9,279,429 B2 3/2016 Hancock
10,718,536 B2 * 7/2020 Hancock ..... F04D 29/422
2004/0253101 A1 * 12/2004 Hancock ..... F04D 29/626 415/213.1
2006/0165521 A1 * 7/2006 Kim ..... F01D 9/026 415/204
2011/0243720 A1 * 10/2011 Post ..... F04D 29/4226 415/204
2012/0211205 A1 * 8/2012 Eguchi ..... F04D 29/281 165/121
2015/0211807 A1 * 7/2015 Groskreutz ..... F28F 1/32 165/172
2015/0369514 A1 * 12/2015 Groskreutz ..... F24F 13/24 62/296
2018/0328369 A1 * 11/2018 Hancock ..... F04D 29/626
2019/0186499 A1 * 6/2019 Pirouzpanah ..... F04D 29/62
2020/0132085 A1 * 4/2020 Chinoda ..... F04D 29/4206
2020/0217328 A1 * 7/2020 Ray ..... F04D 29/403
2021/0148377 A1 * 5/2021 Hayashi ..... F04D 29/424

* cited by examiner

CUTOFF FOR A BLOWER HOUSING

CROSS REFERENCE TO RELATED APPLICATIONS

This application claims priority from and the benefit of U.S. Provisional Application Ser. No. 62/788,631, entitled "CUTOFF FOR A BLOWER HOUSING," filed Jan. 4, 2019, which is herein incorporated by reference in its entirety for all purposes.

BACKGROUND

The present disclosure relates generally to a heating, ventilation, and/or air conditioning (HVAC) system, and more particularly, to a cutoff having a camber cross-sectional geometry for a blower housing of an HVAC system.

HVAC systems are utilized in residential, commercial, and industrial environments to control environmental properties, such as temperature and humidity, for occupants of the respective environments. The HVAC system may control the environmental properties through control of an airflow delivered to the environment. The HVAC system may include a blower assembly that is configured to direct air across a heat exchanger and condition the air or otherwise exchange thermal energy with a refrigerant flowing through tubes of the heat exchanger. Blower assemblies may include a rotor disposed within a housing to draw air from a surrounding environment and direct the air across the heat exchanger. In some cases, the flow of air within the housing of the blower assembly may include pockets of high velocity that generate turbulent flow. It is now recognized that a portion of the turbulent flow of the air in the housing may be directed back into the housing instead of through an outlet of the blower assembly, thus increasing an amount of energy consumed by the blower assembly to achieve a target flow rate of air and reducing efficiency.

SUMMARY

Figure 1:
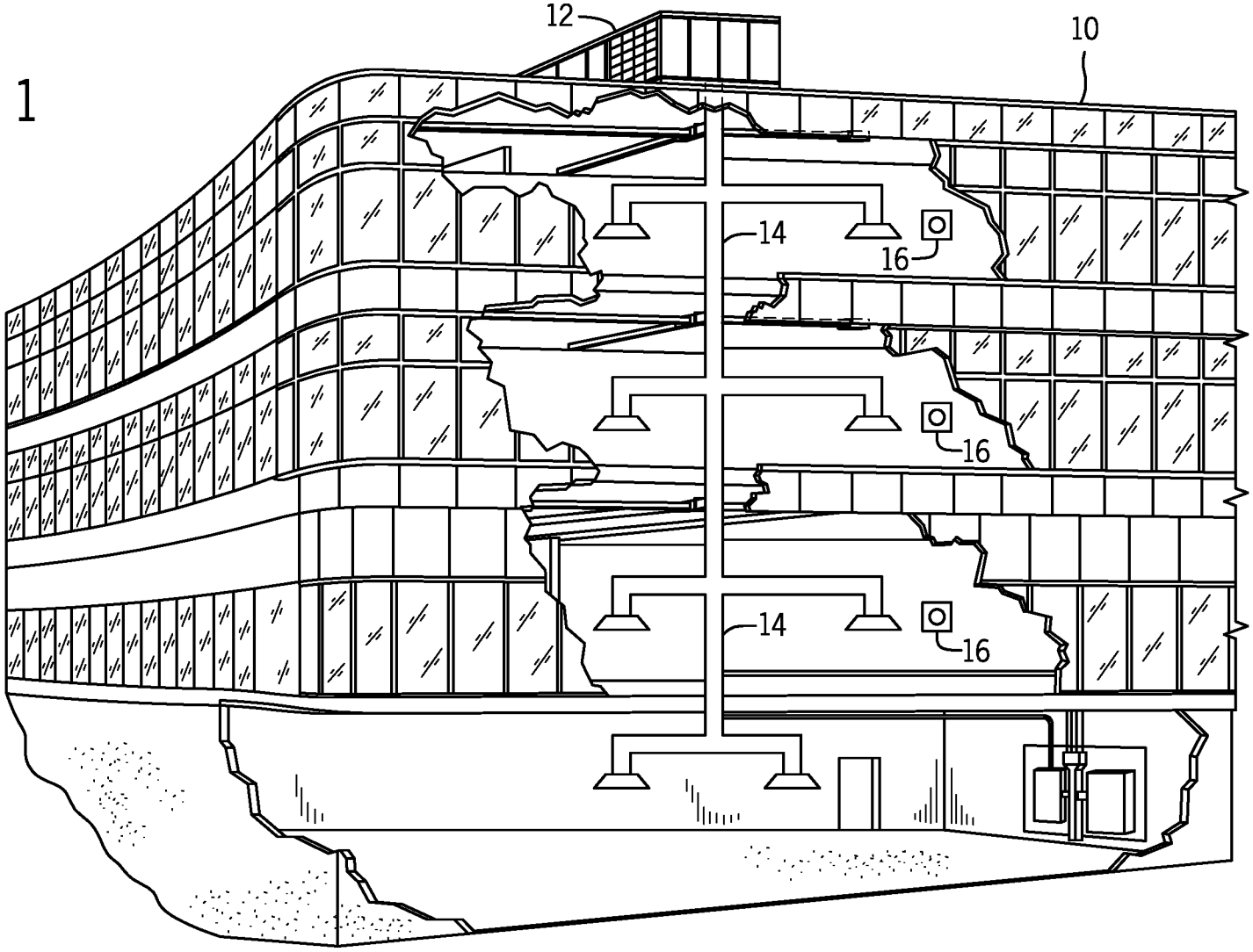
FIG. 1 is a schematic of an embodiment of an HVAC system for building environmental management that includes an HVAC unit, in accordance with an aspect of the present disclosure.

In one embodiment of the present disclosure, a centrifugal blower includes a centrifugal fan including a fan wheel, where the fan wheel has a rotational axis and blades extending radially outwardly from the fan wheel. The centrifugal fan blower also includes a blower housing with a first housing panel and a second housing panel disposed on opposite sides of the centrifugal fan and extending transverse to the rotational axis of the fan wheel. A wall extends about the rotational axis and between the first housing panel and the second housing panel, where the wall includes a flange having a cross-sectional camber geometry, and an intake passage extends through the first housing panel and facilitates fluid flow into the fan wheel. An outlet of the housing facilitates fluid flow out of the fan wheel and out of the housing, and the outlet is formed by the first housing panel, the second housing panel, and the wall. The flange extends outwardly from the outlet.

In another embodiment of the present disclosure, a heating, ventilation, and/or air conditioning (HVAC) system includes a heat exchanger having a plurality of tubes configured to flow a refrigerant therethrough and a blower assembly having a housing and a fan wheel. Rotation of the fan wheel is configured to direct a flow of air across the plurality of tubes of the heat exchanger to place the flow of air in thermal communication with the refrigerant. The housing includes a first housing panel, a second housing panel, and a wall extending between the first housing panel and the second housing panel, and the wall includes a flange having a cross-sectional camber geometry that extends outwardly from an outlet of the blower assembly.

In a further embodiment of the present disclosure, a cutoff of a blower assembly housing for a heating, ventilation, and air conditioning (HVAC) system includes a body portion formed in a wall of the blower assembly housing and extending in a first direction toward an outlet of the blower assembly, a leading edge portion extending from the body portion, and a curved portion having a first end and a second end. The curved portion extends from the leading edge portion at the first end and the curved portion includes a curvature extending outwardly away from the body portion and the outlet of the blower assembly. A trailing edge portion extends from the second end of the curved portion and is configured to extend from the curved portion in a second direction away from the outlet of the blower assembly housing, such that the cutoff forms a generally camber cross-sectional geometry.

Other features and advantages of the present application will be apparent from the following, more detailed description of the embodiments, taken in conjunction with the accompanying drawings which illustrate, by way of example, the principles of the application.

DETAILED DESCRIPTION

The present disclosure is directed to an improved cutoff for a blower assembly that may increase an efficiency of a heating, ventilation, and air conditioning (HVAC) system.

As set forth above, a rotor of the blower assembly may draw air into a housing and increase a velocity of the air to direct an air flow toward a heat exchanger of the HVAC system. In some cases, the flow of air may include pockets of high velocity that may generate turbulent flow. Unfortunately, the turbulent flow may cause at least a portion of the air flow to be directed back into a housing of the blower assembly and/or otherwise not flow out of an outlet of the blower assembly toward the heat exchanger. As such, a motor driving rotation of the rotor may consume additional power to generate a target flow rate of air across the heat exchanger, thereby reducing an efficiency of the blower assembly.

Accordingly, embodiments of the present disclosure are directed to an improved cutoff of a blower assembly that may facilitate a flow of air through an outlet of a housing of the blower assembly and increase efficiency. For example, the cutoff of the blower assembly may include a cross-sectional camber geometry, such as an airfoil shape, that may guide the air flow toward an outlet of the blower assembly. The cross-sectional camber geometry of the cutoff may include a leading edge portion and a trailing edge portion that increases an amount of the air flow directed toward the outlet of the blower assembly. Additionally, the cross-sectional camber geometry may include a curved portion between the leading edge portion and the trailing edge portion that further facilitates directing the air flow toward the outlet. In any case, the cross-sectional camber geometry of the cutoff may reduce an amount of the air flow that is directed back into a housing of the blower assembly instead of being discharged from the outlet of the blower assembly. In other words, the cross-sectional camber geometry of the cutoff may direct the air flow to move across surfaces of the cutoff toward the outlet of the blower assembly. As such, an amount of power consumed by a drive of the blower assembly to achieve a target flow rate of the air flow may be reduced and an efficiency of the blower assembly may increase.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
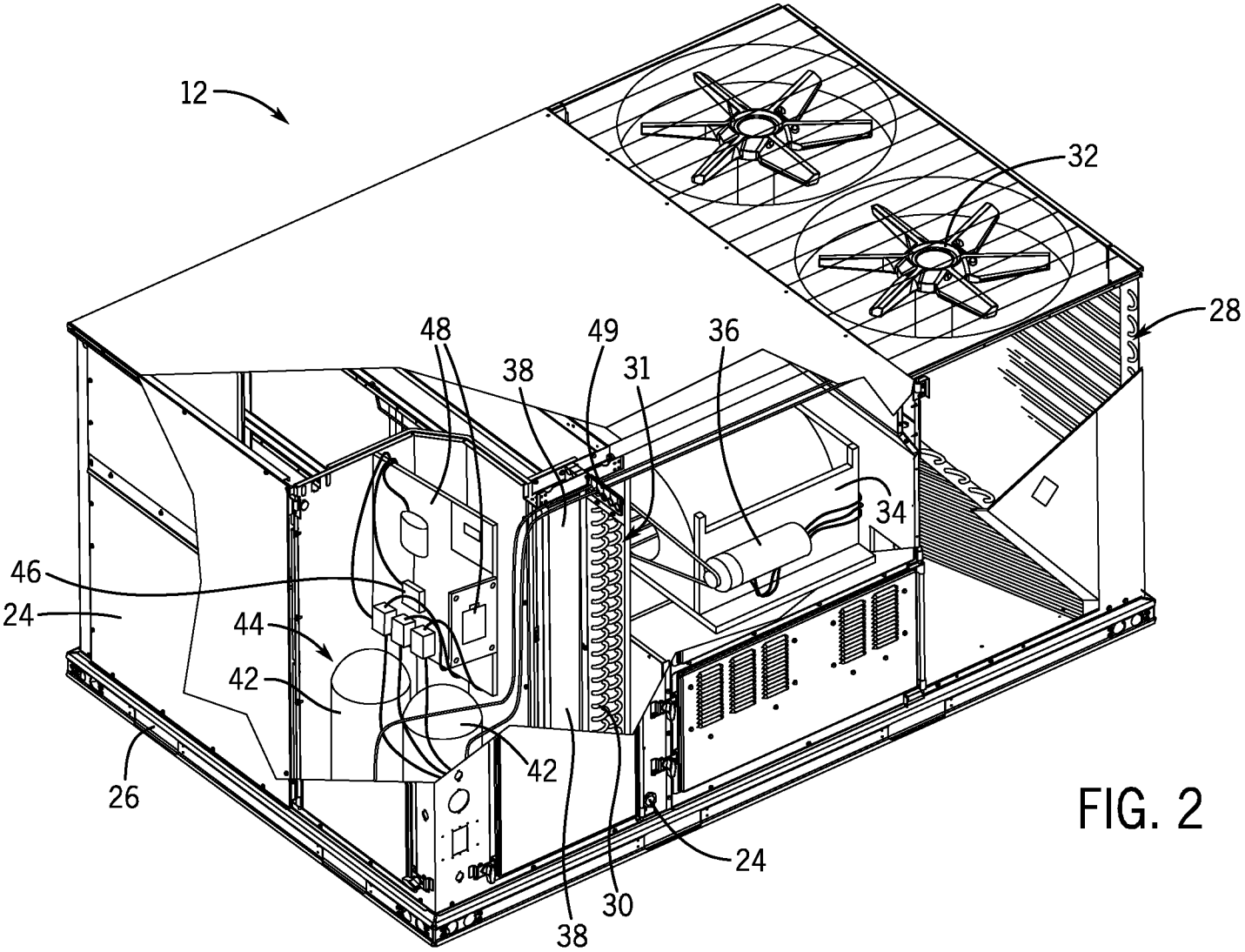
FIG. 2 is a perspective view of an embodiment of an HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
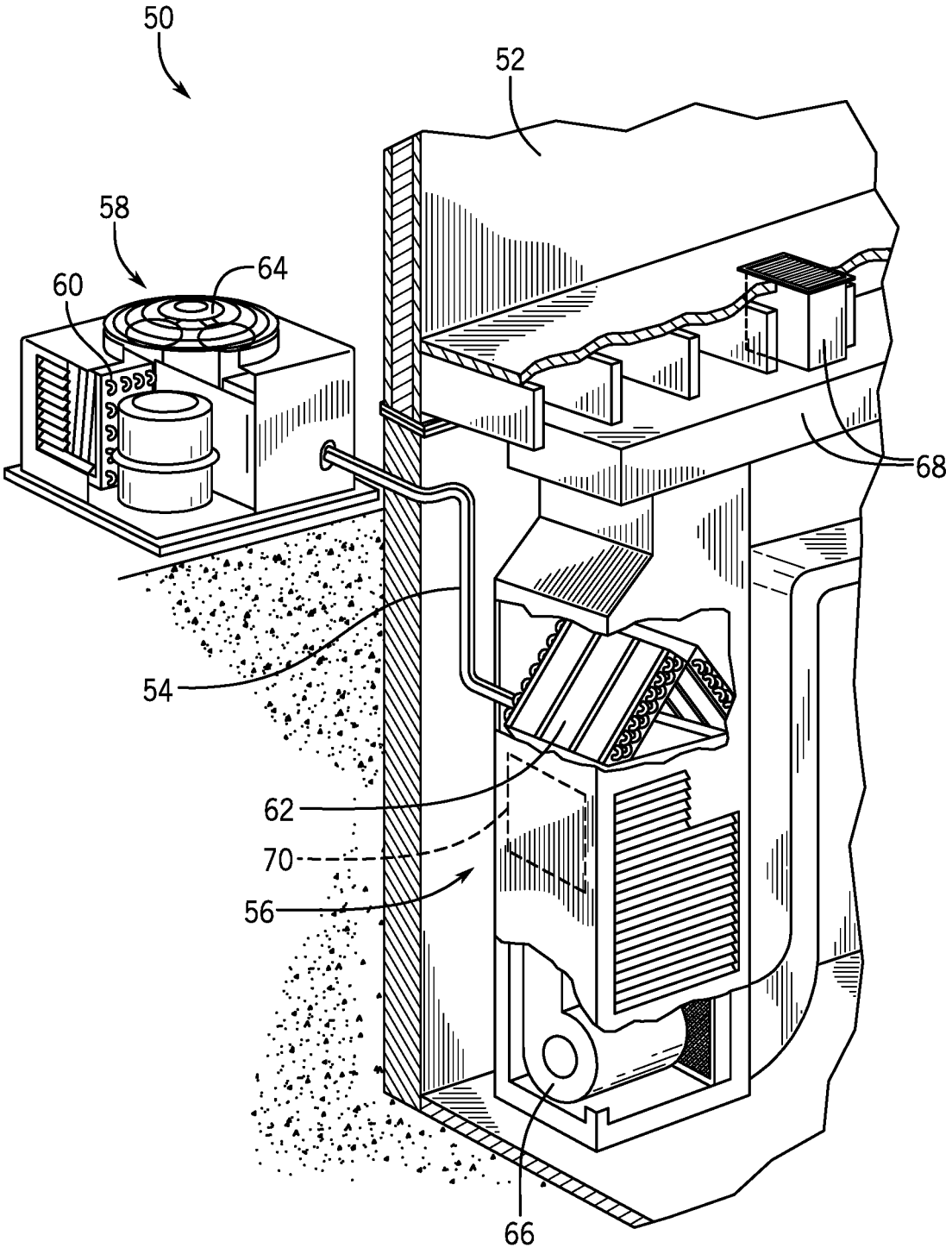
FIG. 3 is a cutaway perspective view of an embodiment of a split, residential heating and cooling system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
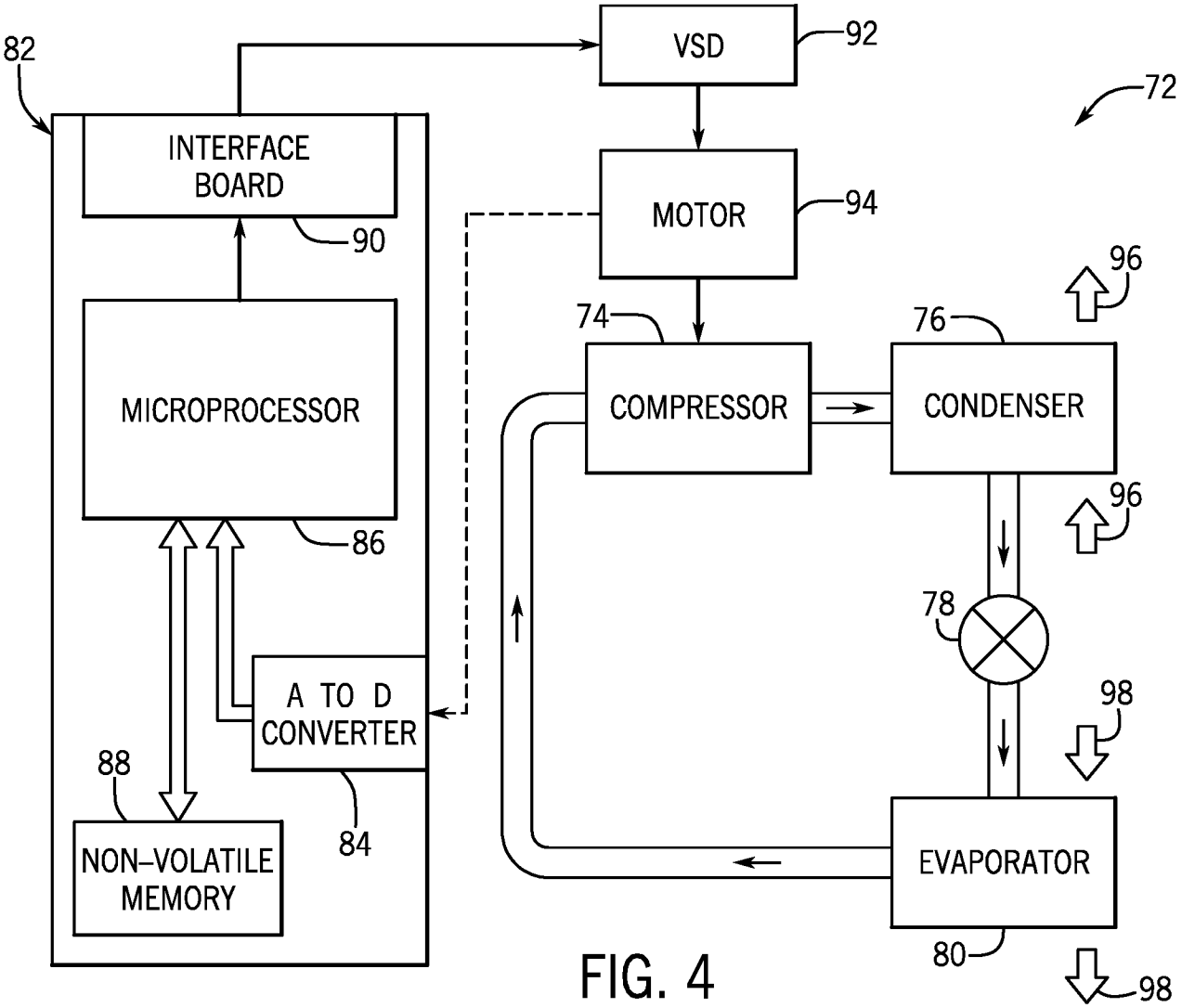
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As set forth above, embodiments of the present disclosure are directed to an improved blower assembly having a cutoff that includes a cross-sectional camber geometry. As used herein, a cutoff of the blower assembly refers to a portion of a housing of the blower assembly that is positioned proximate to an outlet of an air flow directed from the blower assembly. The cutoff may include a flange extending away from the outlet that includes the cross-sectional camber geometry. The geometry of the cutoff may direct the air flow through the outlet of the blower assembly instead of back toward a rotor, such as a fan wheel, of the blower assembly and/or otherwise back into the housing of the blower assembly. In some cases, the flange is formed within a wall of the housing that extends between a first housing panel and a second housing panel that are disposed on opposite sides of the rotor of the blower assembly. The first housing panel and the second housing panel may include openings and/or inlets that enable air from a surrounding environment to be drawn into the housing of the blower assembly. Rotation of the rotor within the housing may increase a velocity of the air and direct the air from the outlet of the blower assembly toward a heat exchanger of an HVAC system, such as the HVAC unit 12 and/or the residential heating and cooling system 50. In any case, the cutoff may facilitate directing the air toward the outlet of the blower assembly, thereby reducing an amount of air that recirculates within the housing. The geometry of the cutoff may reduce an amount of power consumed by a drive that is configured to rotate the rotor, which may increase an efficiency of the blower assembly.

Figure 5:
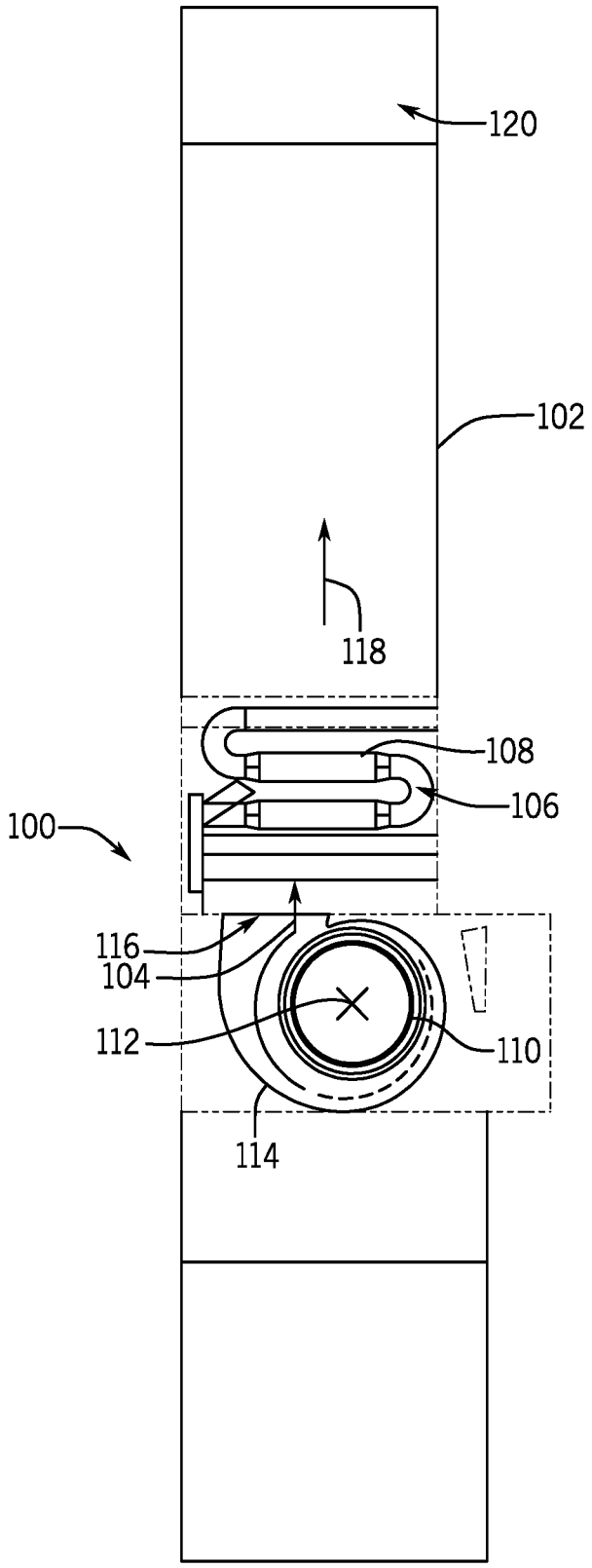
FIG. 5 is a side view of an embodiment of a blower assembly and a heat exchanger disposed within ductwork of a structure, in accordance with an aspect of the present disclosure.

For example, FIG. 5 is an elevation view of an embodiment of a blower assembly 100, such as the blower assembly 34, disposed within a duct assembly 102, such as the ductwork 14, and configured to direct a flow of air 104 across a heat exchanger 106. The heat exchanger 106 conditions the flow of air 104 by placing the flow of air 104 in thermal communication with a refrigerant flowing through tubes 108 of the heat exchanger 106. The blower assembly 100 includes a rotor 110, such as a fan wheel, that is configured to rotate about an axis 112 extending through a housing 114 of the blower assembly 100. As the rotor 110 rotates about the axis 112, blades of the rotor 110 draw air into the housing 114 of the blower assembly 100 and increase a velocity of the air to generate the flow of air 104. The flow of air 104 is directed through an outlet 116 of the housing 114 and toward the heat exchanger 106. After exchanging thermal energy with the refrigerant in the heat exchanger 106, a conditioned air flow 118 is directed toward an outlet 120 of the duct assembly 102 to condition an environment within a structure, such as the building 10. As set forth above, the blower assembly 100 may include an improved cutoff that facilitates directing the flow of air 104 toward the heat exchanger 106 and reduces an amount of air that is directed back into the housing 114 of the blower assembly, thereby enhancing an efficiency of the blower assembly 100.

Figure 6:
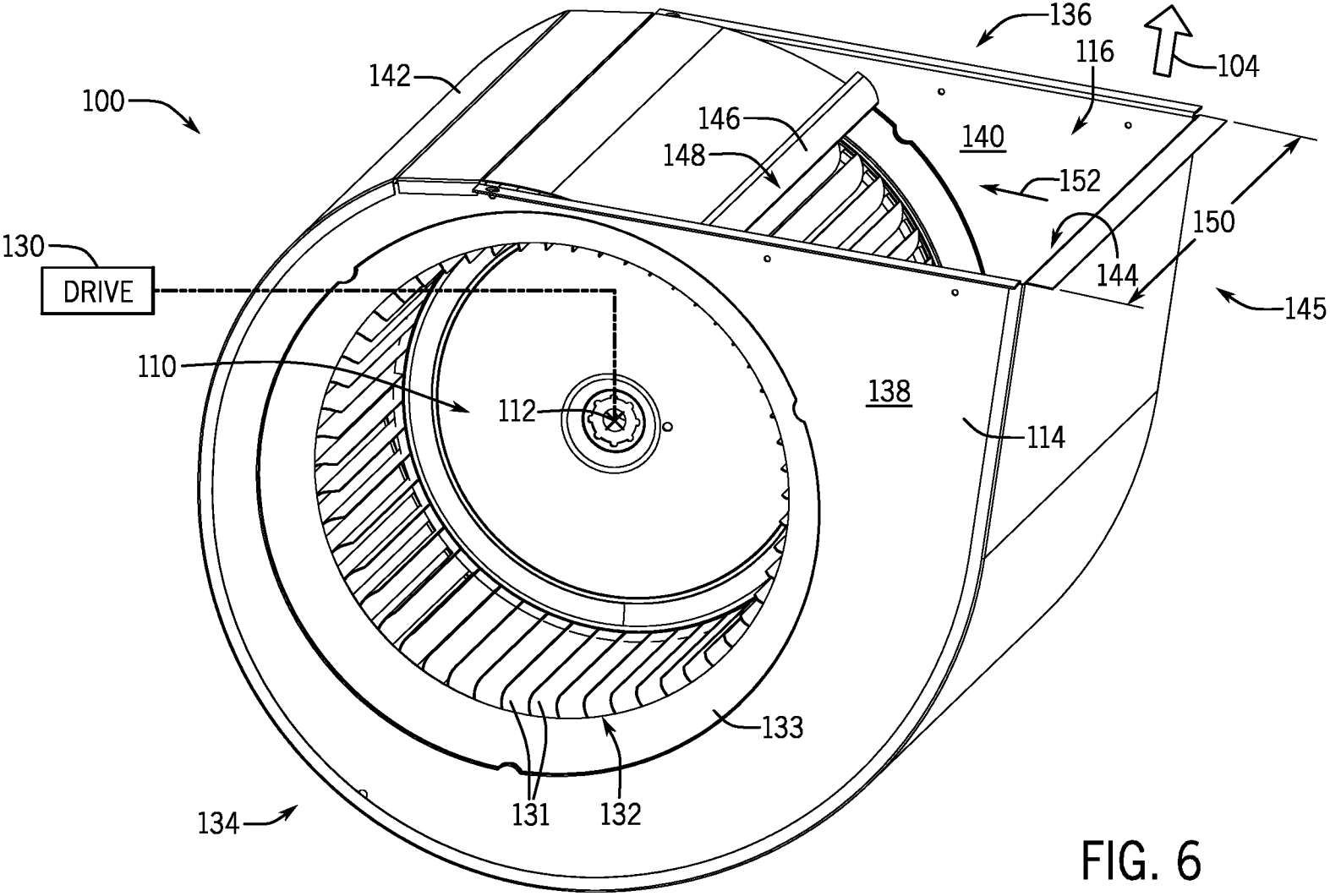
FIG. 6 is a perspective view of an embodiment of the blower assembly having a cutoff with a cross-sectional camber geometry, in accordance with an aspect of the present disclosure.

FIG. 6 is a perspective view of an embodiment of the blower assembly 100. As shown in the illustrated embodiment of FIG. 6, the blower assembly 100 includes the rotor 110 configured to rotate about the axis 112. In some embodiments, the blower assembly 100 includes a drive 130, such as the motor 36, that rotates the rotor 110 about the axis 112. As the rotor 110 rotates about the axis 112, blades 131 of the rotor may draw air into the housing 114 of the blower assembly 100 via an inlet 132 on a first side 134 of the blower assembly 100. It should be understood that the blower assembly 100 may include an additional inlet on a second side 136 of the blower assembly 100, opposite the first side 134. In some embodiments, the inlet 132 may include an annulus having a curved face 133 which may facilitate drawing the air into the housing 114 of the blower assembly 100. For example, the air may generally flow through the annulus and along, or adhere to, the curved face 133, which may direct the air into the housing 114. In any case, air is drawn into the housing 114 of the blower assembly 100 and increases in velocity as a result of rotation of the rotor 110 about the axis 112. The flow of air 104 is directed out of the housing 114 via the outlet 116, which may ultimately direct the flow of air 104 toward the heat exchanger 106, such as the heat exchanger 30.

As shown in the illustrated embodiment of FIG. 6, the housing 114 of the blower assembly 100 includes a first housing panel 138 disposed on the first side 134 of the blower assembly 100 and a second housing panel 140 disposed on the second side 136 of the blower assembly 100. The first housing panel 138 and the second housing panel 140 extend transverse to the axis 112 about which the rotor 110 rotates. The first housing panel 138 may include the inlet 132, which may enable the flow of air to be drawn into the housing 114. Additionally, the housing 114 includes a wall 142 that extends between the first housing panel 138 and the second housing panel 140. In some embodiments, the housing 114 having the first housing panel 138, the second housing panel 140, and the wall 142 is formed from sheet metal or another suitable metallic material. In other embodiments, the housing 114 having the first housing panel 138, the second housing panel 140, and the wall 142 may include a polymeric material or another suitable material. Together the first housing panel 138, the second housing panel 140, and the wall 142 form a chamber 144 within the housing 114, as well as the outlet 116. In some embodiments, the wall 142 extends from an end 145 of the first housing panel 138 and the second housing panel 140 and around the rotor 110 about the axis 112 to form a semi-circular cross-sectional geometry. The chamber 144 of the housing 114 enables the air to increase in velocity, such that the flow of air 104 emitted from the outlet 116 achieves a target flow rate for thermal communication with the heat exchanger 106.

As set forth above, the air within the chamber 144 of the housing 114 may be redirected back into the housing 114 and/or the chamber 144 instead of through the outlet 116, which may reduce an efficiency of the blower assembly 100. Accordingly, the wall 142 includes a cutoff 146, such as a flange, that includes a particular geometry, such as a cross-sectional camber geometry, that reduces an amount of air that is redirected back into the chamber 144 of the housing 114 and increases an efficiency of the blower assembly 100. As shown in the illustrated embodiment of FIG. 6, the cutoff 146 includes a cross-sectional camber geometry. In other words, the cutoff 146 may include an air foil shape that may facilitate directing the flow of air 104 through the outlet 116 and across a surface 148 of the cutoff 146 as opposed to enabling the flow of air 104 to return toward the rotor 110 and/or otherwise back within the housing 114.

As shown in the illustrated embodiment of FIG. 6, the cutoff 146 extends along the wall 142 from the first housing panel 138 to the second housing panel 140 and into a cavity portion of the outlet 116. In other words, the cutoff 146 extends across a length 150 of the outlet 116 and enables the flow of air 104 to be directed across the surface 148 and toward the heat exchanger 106 downstream of the blower assembly 100. The cutoff 146 is positioned offset from the rotor 110, thereby directing the flow across the surface 148 rather than in a direction 152 back into the housing 114, which may increase the efficiency of the blower assembly 100.

Figure 7:
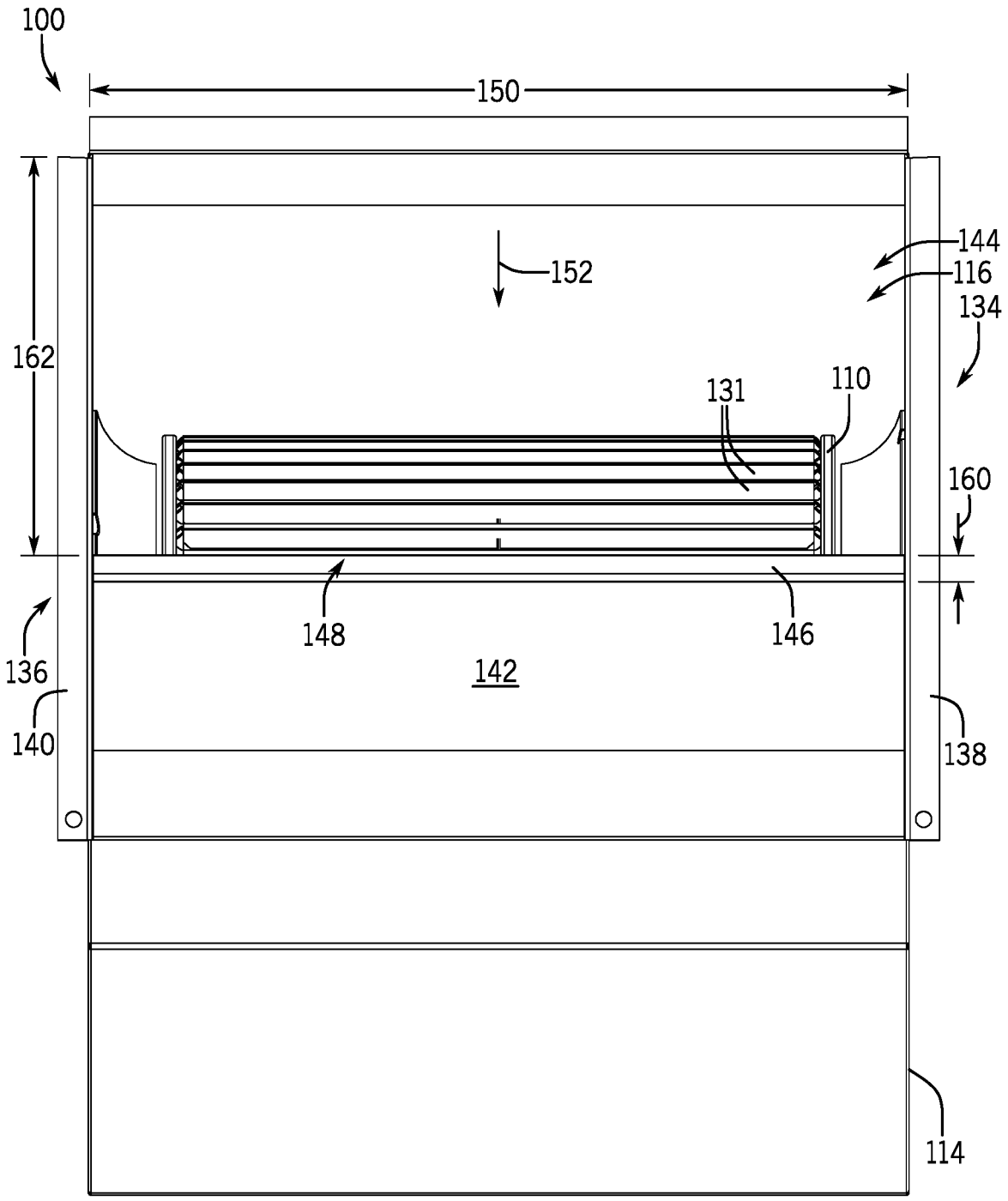
FIG. 7 is a top view of an embodiment of the blower assembly, in accordance with an aspect of the present disclosure.

FIG. 7 is a top view of the blower assembly 100 illustrating the cutoff 146 positioned at the outlet 116 of the blower assembly 100. As shown in the illustrated embodiment of FIG. 7, the cutoff 146 includes a length 160 that is configured to direct the flow of air through the outlet 116 and across the surface 148 toward the heat exchanger 106. In some embodiments, the length 160 may be between 0.1 inches and 1 inch, between 0.25 inches and 0.75 inches, or between 0.4 inches and 0.6 inches. In other embodiments, the length 160 may be based on a width 162 of the outlet 116. For instance, the length 160 may be between 1% and 20%, between 2% and 15%, or between 5% and 10% of the width 162 of the outlet 116. In any case, the geometry of the cutoff 146 may direct flow across the surface 148 and away from the rotor 110 and/or the chamber 144 of the housing 114. The length 160 of the cutoff 146 may be defined by the distance between a leading edge portion of the cutoff 146 and a trailing edge portion of the cutoff 146.

Figure 8:
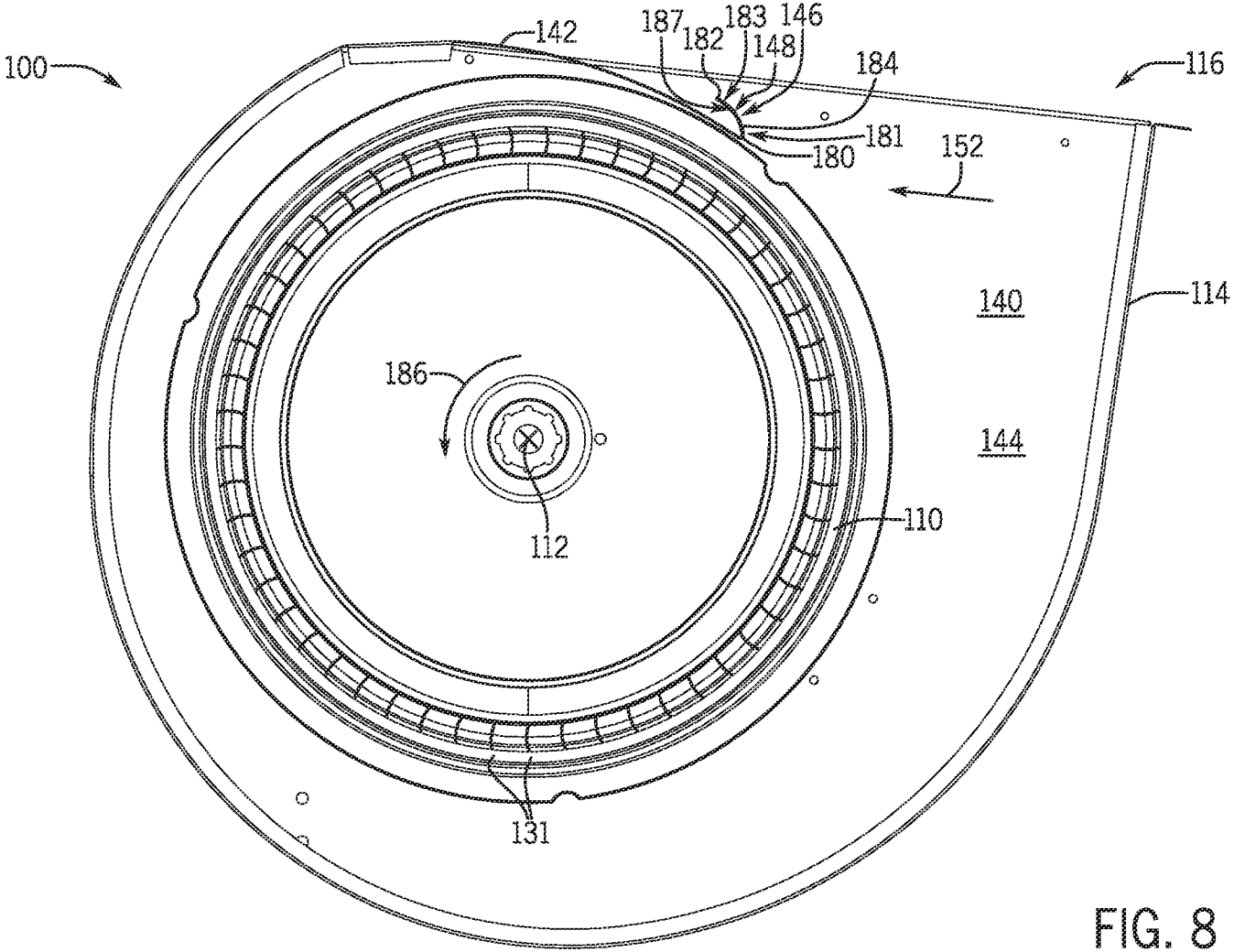
FIG. 8 is a cross-section of an embodiment of the blower assembly illustrating the cross-sectional camber geometry of the cutoff, in accordance with an aspect of the present disclosure.

For example, FIG. 8 is a cross-section of an embodiment of the blower assembly 100 illustrating a geometry of the cutoff 146. As shown in the illustrated embodiment of FIG. 8, the cutoff 146 includes a cross-sectional camber geometry. As such, the cutoff 146 includes a leading edge 180 of a leading edge portion 181 and a trailing edge 182 of a trailing edge portion 183 forming the camber geometry. The cutoff 146 may also include a curved portion 184 between the leading edge portion 181 and the trailing edge portion 183 and having a curvature that extends about the axis 112. In other words, the curved portion 184 may form a camber line of the camber geometry of the cutoff 146 that extends at least partially about the axis 112. As such, the surface 148 of the cutoff 146 (e.g., exterior surface) may form a generally convex shape and an interior surface 187 of the cutoff 146 forms a generally concave shape. In some embodiments, the trailing edge portion 183 extends away from the outlet 116 and forms a distal end of the cutoff 146. The camber geometry may direct the flow of air 104 across the surface 148 and reduce an amount of the flow of air 104 that flows back into the housing 114 in the direction 152. For example, the rotor 110 may rotate about the axis 112 in a circumferential direction 186. Accordingly, air is drawn through the inlet 132 and directed through the chamber 144 in the circumferential direction 186. The air may increase in velocity as it flows through the chamber 144 and toward the outlet 116. Conventional blower assemblies, the cutoff may enable the flow of air 104 to be directed back into the chamber 144 and thus mix with the air being drawn into the housing 144 via the inlet 132, thereby reducing an efficiency of the blower assembly. In accordance with embodiments of the present disclosure, the camber geometry of the cutoff 146 directs the flow of air 104 over the cutoff 146 and across the surface 148, thus directing the flow of air 104 through the outlet 116 and toward the heat exchanger 106. As such, the camber geometry reduces an amount of the flow of air 104, or eliminates a portion of the flow of air 104 that is redirected back into the housing 114, which increases an efficiency of the blower assembly 110 by reducing an amount of power utilized to drive the rotor 110 to achieve a target flow rate of the flow of air 104. Specifically, this guidance of airflow and avoidance of inefficient back flow is believed to be a result of resistance to undesired turbulent pockets the airflow and laminar flow guidance provided by the camber geometry.

As shown in the illustrated embodiment of FIG. 8, a cross-sectional area, such as a radial dimension, of the chamber 144 may increase in the circumferential direction 186 from the cutoff 146. The increasing cross-sectional area or radial dimension of the chamber 144 enables the velocity of the flow of air 104 to increase and achieve a target flow rate that may increase an amount of heat transfer between the flow of air 104 and the refrigerant flowing through the heat exchanger 106. In some embodiments, the cross-sectional area of the chamber 144 is greatest at the outlet 116 of the housing 114. In any case, the cross-sectional area of the chamber 144 is reduced at the cutoff 146 to reduce an amount of the flow of air 104 that may be directed from the outlet 116 back into the chamber 144.

Figure 9:
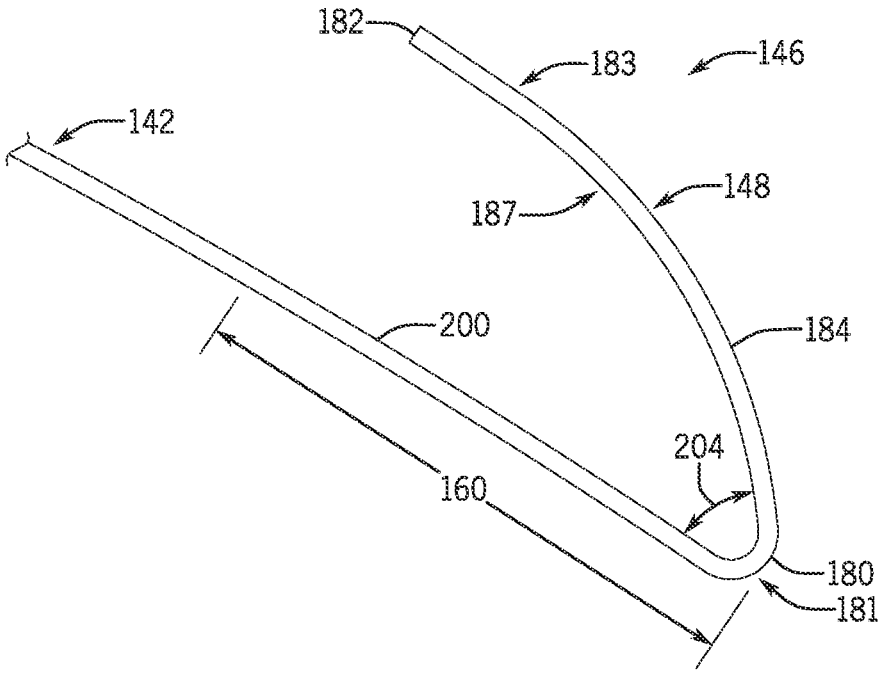
FIG. 9 is an expanded cross-sectional view of an embodiment of the cutoff having the cross-sectional camber geometry, in accordance with an aspect of the present disclosure.

FIG. 9 is an expanded cross-sectional view of the cutoff 146 illustrating the camber geometry. The leading edge portion 181 of the cutoff 146 may extend from a body portion 200 of the wall 142 to the curved portion 184 of the cutoff 146. In some embodiments, the cutoff 146 may bend back from the wall 142 at the leading edge 180. For example, the trailing edge portion 183 of the cutoff 146 may extend from the curved portion 184 in a direction that is generally parallel with the body portion 200, such that the cutoff 146 bends back away from the outlet 116 at generally 180 degrees. Further, the leading edge portion 181 and/or a portion 202 of the curved portion 184 may form an angle 204 with the body portion 200. In some embodiments, the angle 204 may be between 20 degrees and 80 degrees, between 30 degrees and 70 degrees, or between 40 degrees and 60 degrees. Together, the angle 204 and the curved portion 184 may enable the trailing edge portion 183 to be generally parallel to the body portion 200 and form the camber geometry of the cutoff 146.

As set forth above, the camber geometry of the cutoff 146 may direct the flow of air 104 through the outlet 116 toward the heat exchanger 106. For instance, the leading edge 180 of the cutoff 146 may facilitate flow of the air flow 104 through the outlet 116 by directing the flow of air 104 generally along the curved portion 184 and toward the heat exchanger 106. As such, an amount of the flow of air 104 that flows back into the chamber 144 is reduced. Portions of the flow of air 104 that are directed back into the chamber 144 may increase an amount of power utilized to drive the rotor 110 about the axis 112 and achieve a target flow rate of the flow of air 104 directed toward the heat exchanger 106, which reduces an efficiency of the blower assembly 100. Accordingly, the camber geometry of the cutoff 146 may reduce an amount of power utilized to drive the rotor 104 and achieve the target flow rate of the flow of air 104 directed toward the heat exchanger 106, thereby increasing an efficiency of the blower assembly 100.

As set forth above, embodiments of the present disclosure may provide one or more technical effects useful in increasing an efficiency of an HVAC system. For example, embodiments of the present disclosure are directed to a cutoff of a housing of a blower assembly that includes a cross-sectional camber geometry. The cutoff may include a leading edge portion, a trailing edge portion, and a curved portion that cooperate to direct a flow of air through an outlet of the housing of the blower assembly and reduce an amount of air redirected into a chamber of the housing. The reduction of air that is redirected into the chamber of the housing may reduce an amount of power utilized to drive rotation of a rotor of the blower assembly, which may increase an efficiency of the blower assembly and thus, the HVAC system. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A centrifugal blower, comprising:

a centrifugal fan including a fan wheel, wherein the fan wheel has a rotational axis, and including blades extending radially outwardly from the fan wheel;

a blower housing including a first housing panel and a second housing panel disposed on opposite sides of the centrifugal fan and extending transverse to the rotational axis of the fan wheel, and further including a wall extending about the rotational axis from a first edge of the wall to a second edge of the wall and between the first housing panel and the second housing panel, wherein the wall includes a flange having a cross-sectional camber geometry and a leading edge portion of the cross-sectional camber geometry positioned between the first edge and the second edge, wherein the second edge is positioned between the rotational axis and the first edge, and wherein the wall is a single-piece component extending between the first edge and the second edge;

an intake passage extending through the first housing panel and facilitating fluid flow into the fan wheel; and an outlet of the blower housing facilitating fluid flow out of the fan wheel and out of the blower housing, wherein a perimeter of the outlet is formed by the first housing panel, the second housing panel, the leading edge portion of the cross-sectional camber geometry, and the first edge of the wall, wherein the perimeter of the outlet includes a quadrilateral geometry, and wherein the flange extends outwardly from the outlet.

2. The centrifugal blower of claim 1, wherein a trailing edge of the cross-sectional camber geometry is a distal portion of the wall and defines the second edge of the wall.

3. The centrifugal blower of claim 1, wherein a camber line of the cross-sectional camber geometry extends partially about the rotational axis.

4. The centrifugal blower of claim 1, wherein a radially outer surface of the flange, relative to the rotational axis, is a convex surface.

5. The centrifugal blower of claim 1, wherein a radially inner surface of the flange, relative to the rotational axis, is a concave surface.

6. The centrifugal blower of claim 1, wherein the flange includes a curved portion extending from the leading edge portion at a first end of the curved portion, and a trailing edge portion extending from the curved portion at a second end of the curved portion, wherein the trailing edge portion defines the second edge of the wall.

7. The centrifugal blower of claim 6, wherein the trailing edge portion extends from the curved portion in a direction that is generally parallel to a body portion of the wall.

8. The centrifugal blower of claim 7, wherein the leading edge portion forms an angle with the body portion of the wall that is between 40 degrees and 60 degrees.

9. The centrifugal blower of claim 1, wherein the flange includes a length that is between 5% and 10% of a width of the outlet.

10. The centrifugal blower of claim 1, wherein the outlet of the blower housing is configured to direct the fluid flow out of the blower housing and toward a heat exchanger of a heating, ventilation, and air conditioning (HVAC) system.

11. The centrifugal blower of claim 1, comprising an additional intake passage extending through the second housing panel and facilitating fluid flow into the fan wheel.

12. The centrifugal blower of claim 1, wherein a radial dimension of a chamber within the blower housing increases in a circumferential direction about the rotational axis and along the wall from the leading edge portion of the cross-sectional camber geometry toward the first edge of the wall.

13. The centrifugal blower of claim 1, wherein the wall is made from a metallic material.

14. The centrifugal blower of claim 1, wherein the intake passage comprises an annulus with a curved face configured to facilitate fluid flow into the fan wheel.

15. A heating, ventilation, and/or air conditioning (HVAC) system, comprising:

a heat exchanger having a plurality of tubes configured to flow a refrigerant therethrough; and a blower assembly having a housing and a fan wheel, wherein rotation of the fan wheel is configured to direct a flow of air across the plurality of tubes of the heat exchanger to place the flow of air in thermal communication with the refrigerant, wherein the housing includes a first housing panel, a second housing panel, and a wall extending between the first housing panel and the second housing panel, wherein the wall is a single-piece component and extends about a rotational axis of the fan wheel from a first edge of the wall to a second edge of the wall, wherein the wall includes a flange having a cross-sectional camber geometry that extends outwardly from an outlet of the blower assembly, wherein the flange defines a leading edge portion of the cross-sectional camber geometry positioned between the first edge and the second edge, wherein the second edge is positioned between the rotational axis and the first edge, wherein a perimeter of the outlet is formed by the first housing panel, the second housing panel, the leading edge portion of the cross-sectional camber geometry, and the first edge of the wall, and wherein the perimeter of the outlet includes a quadrilateral geometry.

16. The HVAC system of claim 15, wherein a trailing edge of the cross-sectional camber geometry is a distal portion of the wall and defines the second edge of the wall.

17. The HVAC system of claim 15, wherein a camber line of the cross-sectional camber geometry extends partially about the rotational axis of the fan wheel.

18. The HVAC system of claim 17, wherein a radially outer surface of the flange, relative to the rotational axis, is a convex surface.

19. The HVAC system of claim 17, wherein the wall is made from a metallic material.

20. The HVAC system of claim 15, wherein the heat exchanger and the blower assembly are disposed within ductwork of a structure configured to be conditioned by the HVAC system.

21. A blower assembly housing for a heating, ventilation, and air conditioning (HVAC) system, comprising:

a first housing panel;

a second housing panel positioned opposite the first housing panel to form at least a portion of a chamber configured to receive a fan wheel;

a wall extending between the first housing panel and the second housing panel and about a rotational axis around which the fan wheel is configured to rotate, wherein the wall comprises a first edge and a second edge, wherein the second edge is positioned between the rotational axis and the first edge, wherein the wall is a single-piece component and comprises:

a body portion extending in a first direction toward an outlet of the blower assembly housing;

a leading edge portion extending from the body portion and positioned between the first edge and the second edge;

a curved portion extending from the leading edge portion, wherein the curved portion includes a curvature extending outwardly away from the body portion and the outlet of the blower assembly housing; and a trailing edge portion extending from the curved portion, wherein the trailing edge portion is configured to extend from the curved portion in a second direction away from the outlet of the blower assembly housing, such that the leading edge portion, the curved portion, and the trailing edge portion form a generally camber cross-sectional geometry, wherein the first housing panel, the second housing panel, the leading edge portion, and the first edge of the wall are configured to define a perimeter of the outlet, and wherein the perimeter of the outlet includes a quadrilateral geometry.

22. The blower assembly housing of claim 21, wherein the trailing edge portion extends in a direction that is generally parallel to the body portion of the wall.

23. The blower assembly housing of claim 21, wherein the leading edge portion forms an angle with the body portion that is between 40 degrees and 60 degrees.

24. The blower assembly housing of claim 21, wherein a trailing edge of the trailing edge portion defines the second edge.

* * * * *